United States Patent [19]

Betters

[11] Patent Number: 4,886,038

[45] Date of Patent: Dec. 12, 1989

[54] CABLE SLIDE GUIDE FOR COMPOUND BOWS

[76] Inventor: Gordon J. Betters, Zim Rd., Star Rte. 4, Box 154 A, Hibbing, Minn. 55746

[21] Appl. No.: 139,022

[22] Filed: Dec. 29, 1987

[51] Int. Cl.[4] ..... F41B 5/00

[52] U.S. Cl. ..... 124/23 R; 124/88; 124/DIG. 1

[58] Field of Search ..... 124/24 R, 23 R, DIG. 1, 124/90, 88, 86

[56] References Cited

U.S. PATENT DOCUMENTS

| | | | |
|---|---|---|---|
| 4,332,231 | 6/1982 | Napier et al. | 124/24 R |
| 4,452,222 | 6/1984 | Quartino et al. | 124/24 R |
| 4,524,750 | 6/1985 | Darlington | 124/23 R |
| 4,542,732 | 9/1985 | Troncoso | 124/24 R |
| 4,596,228 | 6/1986 | Smith | 124/23 R |
| 4,732,133 | 3/1988 | Chattin | 124/90 X |
| 4,741,320 | 5/1988 | Wiard | 124/24 R |

*Primary Examiner*—Andrew V. Kundrat
*Assistant Examiner*—Peter M. Cuomo
*Attorney, Agent, or Firm*—Charles G. Mersereau

[57] ABSTRACT

An improved cable slide guide or separation device is disclosed which significantly reduces friction and wear in the operation of a compound bow system. It consists of a single member which is held by tension between the inner cables and the cable guard has grooves to slideably receive the inner cables on one side and is shaped to slideably receive the cable guard on the other.

15 Claims, 1 Drawing Sheet

CABLE SLIDE GUIDE FOR COMPOUND BOWS

BACKGROUND OF THE INVENTION

1. Field of the Invention

The present invention relates to the field of compound bows and more specifically to a low friction cable slide guide which reduces cable wear.

2. Description of the Prior Art

The basic configuration and operation of compound bows is generally known as they have been in use for a long time. Compound bows are used a great deal in archery, especially hunting, because they provide several distinct advantages. Compound bows provide the archer with a mechanical advantage which reduces the maximum draw weight and allows the archer to hold full draw at a draw weight less then that maximum. Also, the system achieves more gradual arrow acceleration upon release with reduced stress on the arrow and the archer. In these and other ways, arrow speed and shooting accuracy are increased.

Compound bows normally have a cable or bowstring which spans the length of the bow and defines a central arrow receiving portion. The cable further extends over end cable wheels or pulleys at the extremes of the length of the bow close to or about parallel to the bowstring cable. The two ends of the cable cross and are attached to the appropriate pulley.

In this manner, however, all the cable strands, including the bowstring, lie in the plane of the center portions of the pulleys. If this situation remained the additional strands of cable would clearly interfere with the bowstring and the arrow being shot.

To alleviate this problem compound bows are normally provided with cable guards which typically include a rod which is fixed to the bow above the arrow window and extends toward the archer, separating and thereby spacing the additional strands of cable from the bowstring cable allowing the arrow to pass therebetween. Unfortunately, the alignment of the cables with each other is such that they necessarily contact each other and rub against each other and the cable guard where they pass by it. This friction causes undue cable wear and adds undesirable noise to the operation of the bow. It can readily be seen that a need exists to provide a slide guide cable separation device that assures proper cable separation during bow operation which prevents frictional wear of the cables both by rubbing against each other and against the cable guard.

One such device is disclosed in U.S. Pat. No. 4,596,228, issued to Smith on June 24, 1986. That cable separator positions the two inner cables on either side of the cable guard. That invention accomplishes separation, however, it is not apparent how well the bowstring is avoided or that frictional wear is reduced. Thus, not only is it desirable that proper separation be achieved, but also frictional wear need be reduced with regard to the cables, cable guard and cable separator. Cable replacement is quite expensive.

SUMMARY OF THE INVENTION

The present invention concerns an improved, inexpensive cable slide guide or separation device which significantly reduces friction in the operation of a compound bow system. This is achieved without any sacrifice of proper inner cable/bowstring cable separations in a uniquely simple fashion.

The present invention contemplates a low-friction cable slide guide in the form of a unitary member having spaced slots adapted to receive the two strands of inner cable spaced in juxtaposed relation on one side thereof and adapted to slideably mount against a typical cable guard on the other.

The cable slide guide or separation member is preferably in the shape of a circumferential fraction of a hollow right circular cylinder having a hollow right circular cylinder having an internal diameter matching the outside diameter of the cable guard and a wall thickness greater than the depth of the deepest cable slot. The slots may be of different depths to assure proper cable separation to prevent the cables from rubbing where they pass crosswise of each other. The slide guide or cable separation member is designed to slideably mount against the rod of the cable guard on the side opposite the bowstring cable held in place by the force produced by the lateral displacement of the two (2) inner cables.

One aspect of the preferred embodiment of the invention proposes to address further friction reduction in relation to the cable separation device. This is accomplished by constructing the device of a low friction material such as graphite. Accordingly, it has been found that the cable separators of the present invention can be readily fabricated from short sections of compressed graphite rod or the like.

DESCRIPTION OF THE PREFERRED EMBODIMENT

Figure 1:
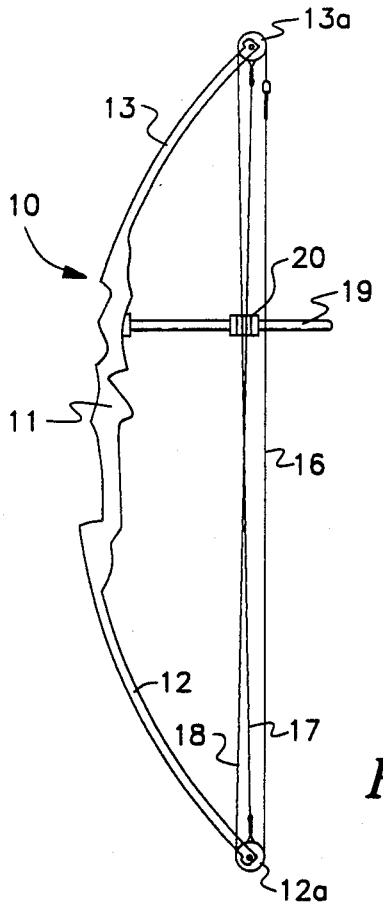
FIG. 1 represents a schematic view of a compound bow having a cable guard and further including a cable separator in accordance with the present invention.

In the drawings there is shown a cable separator and compound bow constructed in accordance with the present invention. FIG. 1 presents a schematic view which shows a compound bow 10 having a handle portion 11 and a pair of limbs 12 and 13, each having a respective extreme or tip end 12*a* and 13*a*. Pulleys 14 and 15 are mounted at the ends 12*a* and 13*a*. They operate in known fashion to provide a mechanical advantage for the bow by an eccentric mounting of the pulleys. A cable includes a bowstring or arrow-receiving portion 16 which extends between the pulleys mounted on the tip ends 12*a* and 13*a* of the bow limbs. The central portion or bowstring connects with inside cable strands 17 and 18 which extend from the pulleys to the opposite bow limbs.

The bow further includes a cable guard in the form of a rod 19 which extends rearwardly from the handle portion 11. The guard extends adjacent the inside cables, and may be somewhat offset to urge the inside cables to one side out of line with the central cable portion 16. Mounted to the cable guard is a cable slide guide separator 20 as provided by the present invention. This slide guide separator facilitates the sliding of the inside cables relative the cable guard, and also prevents the friction associated with one cable sliding over and relative to the other.

Figure 3:
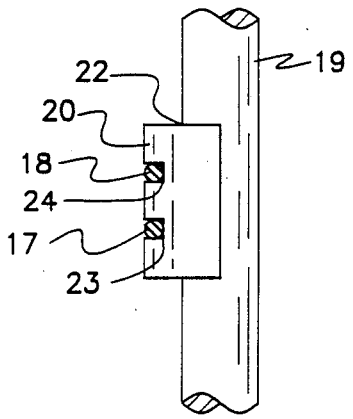
FIG. 3 is a side elevational view of the cable separator of FIG. 2.
Figure 2:
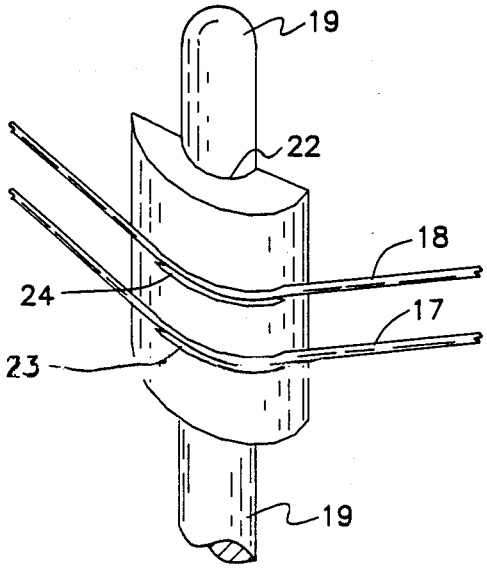
FIG. 2 is an enlarged, fragmentary perspective view of a preferred embodiment of the cable separator of the present invention depicted in FIG. 1.
Figure 4:
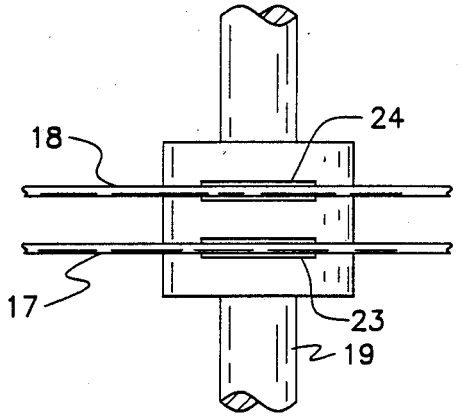
FIG. 4 is a front elevational view of the cable separator.

The cabfe slide guide of the invention is shown in greater detail in the enlarged fragmentary views of FIGS. 2–4. The slide guide 20 includes a member 21 having a surface which is designed to be slideably received against the surface of the cable guard 19. The member 20 is further provided with a pair of spaced grooves 23 and 24. These grooves are designed to be substantially parallel to and slideably receive inner cable strands 17 and 18, respectively.

It will be appreciated that mounting the cables 17 and 18 in the grooves 23 and 24 of the slide guide produces a lateral displacement of the inner cable strands !7 and 18 away from the cable guard 19 which, in turn, produces a force on the slide guide member 20 in the direction of the cable guard rod 19. This force, while not great is sufficient to retain the member 20 in place against the cable guard member 19. The compound bow, of course, is operated by pulling back the bowstring or arrow cable 16. When the arrow is fired, the bowstring then moves rapidly forward toward the handle portion 11 and thereafter returns to its normal position. During this motion, the bow members 11, 12, and 13 flex and the slide guide or separator member 20 moves rearward and forward along the cable guide 19. That is, when the bowstring is pulled back prior to shooting, the member 20 also moves rearward and is propelled rapidly forward when an arrow is shot. It will also be appreciate that the cables 17 and 18 move relative to each other along the grooves 23 and 24 during bow operation and that this motion is quite rapid when an arrow is released.

From the above discussion, it is evident that there is considerable friction between the inner cables and the grooves of the cable slide guide and between the slide guide and the cable guard. This friction causes all these coordinating parts, especially the cables, to wear. One aspect of the present invention is to reduce friction in the system, thereby reducing wear in the cables and other parts. This may be accomplished by fabricating the slide guide or cable separator 20 of a low friction material such as compressed graphite or providing the member with a low friction surface such as one made of polytetrafluoroethylene (PTFE) or the like.

While many materials are contemplated and usable for the cable slide guide of the present invention, successful models have been constructed from sections of graphite rod. It has been found that slide guides made by cutting and grooving graphite rod sections are simple, inexpensive and work extremely well. Many of these can be purchased for the value of one bow cable.

The simplicity of the configuration of the cable slide guide of the present invention is readily apparent. The approach of the present invention presents a clear cost savings over prior, more complicated designs while, at the same time, producing what is perceived to be superior performance. Reduced frictional wear of cables and other parts result in more savings. The device is clearly very easy to install.

It is understood that the foregoing examples while preferred and specific are but illustrative of the inventive concept and are not intended to limit the scope of the invention in any manner. It is certainly possible that certain modifications or alterations might occur to those skilled in the art which would be within the scope of the inventive concept.

Having described the invention, what is claimed is:

1. In a compound bow including a handle portion having extensions thereof forming a pair of flexible bow limbs extending oppositely therefrom in a plane, each having a tip end, a plurality of pulleys rotatably mounted to the tip ends of the bow limbs, a bowstring cable extending between the pulleys, cable strands extending between the pulleys, a cable guard fixed to the handle portion and extending rearward therefrom next to and beyond the cable strands, the improvement comprising:

a slide guide member defining a first surface of slideably compatible shape with a surface of the cable guard and defining a second surface substantially opposite in direction from the first surface and containing at least one groove adapted to slideably receive the cable strands, the slide guide member being configured such that when interposed between the cable guard member and the first and second inner cable strands, said inner cable strands are laterally displaced and the first surface freely slideably abuts and engages the cable guard member in a manner that allows direct lateral removal and the second surface freely slideably receives the cable strands and wherein the slide guide member is held against the cable guard member solely by lateral force created by the displacement of said cable strands.

2. The apparatus of claim 1 wherein the slide guide member has surfaces constructed of a relatively hard, low friction material where it engages the cables and the cable guard.

3. The apparatus of claim 2 wherein the slide guide member is graphite.

4. In a compound bow including a handle portion having extensions thereof forming a pair of flexible bow limbs extending oppositely therefrom in a plane, each having a tip end, a plurality of pulleys rotatably mounted to the tip ends of the bow limbs, a bowstring cable extending between the pulleys, first and second inside cable strands extending between the pulleys; a cable guard fixed to the handle portion and extending rearward therefrom next to and beyond the first and second inside cable strands, the improvement comprising:

a slide guide member defining a first surface of slideably compatible shape with a surface of the cable guard and defining a second surface substantially opposite in direction from the first surface and containing a pair of spaced, juxtaposed grooves adapted to slideably receive the first and second inside cable strands, the slide guide member being configured such that when interposed between the cable guard member and the first and second inner cable strands, the strands are laterally displaced and the first surface freely slideably abuts and engages the cable guard member in a manner that allows free direct lateral removal and the second surface freely slideably receives the first and second inner cable strands and wherein the slide guide member is retained against the cable guard member solely by lateral force created by the displacement of said cable strands.

5. The apparatus of claim 4 wherein the slide guide member has surfaces constructed of a relatively hard, low friction material where it engages the cables and the cable guard.

6. The apparatus of claim 5 wherein the slide guide member is graphite.

7. A compound bow comprising:

a handle portion having extensions thereof forming a pair of flexible bow limbs each having a tip end attached to the handle portion and extending oppositely therefrom in a plane;

a plurality of pulleys rotatably mounted to the tip ends of the bow limbs;

a bowstring cable extending between the pulleys;

first and second inside cable strands extending between the pulleys;

a cable guard fixed to the handle portion and extending rearward therefrom next to and beyond the first and second inside cable strands;

a slide guide member interposed between said first and second inside cable strands and said cable guard thereby laterally displacing said first and second inside cable strands, said slide guide member having a first surface of compatible shape with abutting but not surrounding the cable guard so that said slide guide member is freely laterally removable from said cable guard and having a second surface substantially opposite in direction from the first surface and containing a pair of spaced, juxtaposed grooves adapted to slideably receive the first and second inside cable strands, the slide guide member being configured such that when positioned between the cable guard member and the first and second inner cable strands, the first surface freely slideably laterally engages the cable guard member and the second surface freely slideably laterally receives the first and second inner cable strands separating them from each other and the cable guard, the inner cable strands being thereby displaced from their normal position an amount sufficient to produce sufficient lateral force to retain said slide guide against said cable guard, said lateral force being the sole means of retention for said slide guide member.

8. The apparatus of claim 7 wherein the slide guide member is in the general shape of a hollow right circular cylinder segment.

9. The apparatus of claim 8 wherein the slide guide member is in the form of a half cylinder.

10. The apparatus of claim 9 wherein the slide guide member has a reduced friction surface where it engages the cable and the cable guard.

11. The apparatus of claim 9 wherein the slide guide member is graphite.

12. The apparatus of claim 8 wherein the slide guide member has a reduced friction surface where it engages the cable and the cable guard.

13. The apparatus of claim 8 wherein the slide guide member is graphite.

14. The apparatus of claim 1 wherein the slide guide member has a reduced friction surface where it engages the cable and the cable guard.

15. The apparatus of claim 7 wherein the slide guide member is graphite.

* * * * *